United States Patent [19]

Evans

[11] Patent Number: 4,577,167

[45] Date of Patent: Mar. 18, 1986

[54] MICROSTRIP LINE BRANCHING COUPLER HAVING COAXIAL COUPLED REMOTE TERMINATION

[75] Inventor: Gary E. Evans, Trappe, Md.

[73] Assignee: Westinghouse Electric Corp., Pittsburgh, Pa.

[21] Appl. No.: 447,824

[22] Filed: Dec. 3, 1982

[51] Int. Cl.[4] ..... H01P 5/12

[52] U.S. Cl. ..... 333/128; 333/136

[58] Field of Search ..... 333/128, 127, 136, 134, 333/125, 120, 118, 116, 115, 109

[56] References Cited

U.S. PATENT DOCUMENTS

| | | | |
|---|---|---|---|
| 2,425,084 | 8/1947 | Cork et al. | 333/127 |
| 2,976,497 | 3/1961 | Watts Jr. | 333/127 |
| 3,504,304 | 3/1970 | Cappucci | 333/120 |
| 3,784,933 | 1/1974 | Scherer et al. | 333/243 X |
| 4,182,996 | 1/1980 | Spence | 333/127 X |
| 4,465,985 | 8/1984 | Milligan | 333/116 |

FOREIGN PATENT DOCUMENTS

| | | | |
|---|---|---|---|
| 0101641 | 8/1979 | Japan | 333/118 |
| 615355 | 1/1949 | United Kingdom | 333/125 |
| 1419500 | 12/1975 | United Kingdom | 333/125 |

OTHER PUBLICATIONS

Nystrom, L. "A New Broadband High Directivity 3db Hybrid and Power Divider", Proceeding 10th European Microwave Conf., Warsaw, Poland Sep. 8–12, 80.

*Primary Examiner*—Eugene R. LaRoche
*Assistant Examiner*—Benny T. Lee
*Attorney, Agent, or Firm*—J. B. Hinson

[57] ABSTRACT

A strip transmission line power divider having an isolated port remote from the output ports is disclosed. Power division is provided by a two branch strip transmission line. A coaxial transmission line coupled between the output ports of the divider is coupled to an isolated port where terminating resistors of any convenient power rating may be used.

9 Claims, 7 Drawing Figures

MICROSTRIP LINE BRANCHING COUPLER HAVING COAXIAL COUPLED REMOTE TERMINATION

BACKGROUND OF THE INVENTION

1. Field of the Invention:

The invention relates generally to microwave couplers and more specifically to split-tee couplers including means permitting the termination resistors to be positioned at an isolated termination ports which is remote from the output ports of the coupler.

2. Description of the Prior Art

Split-tee (sometimes Wilkinson) couplers are well known in the prior art. It is also well known that power reflected from the load to the output ports of the coupler is either dissipated by a termination resistor coupled across the output ports or is reflected into the driving source. Termination resistors positioned across the output ports of the couplers are generally limited in size and power due to the physical constraints placed on the coupler by the operating frequency. This limited the power ratings of the prior art split-tee couplers and precluded the use of the isolated port of the coupler for other uses.

DESCRIPTION OF THE INVENTION

In accordance with the disclosed invention, a split-tee coupler is provided in which the output ports of the coupler are coupled by a transmission line to a remote termination port. A terminating resistor can be coupled across the termination port or the termination port can be used for other purposes. Embodiments utilizing either one or two termination ports are provided. When an increased bandwidth is required, additional matching sections are provided to increase the bandwidth.

DETAILED DESCRIPTION

Figure 1:
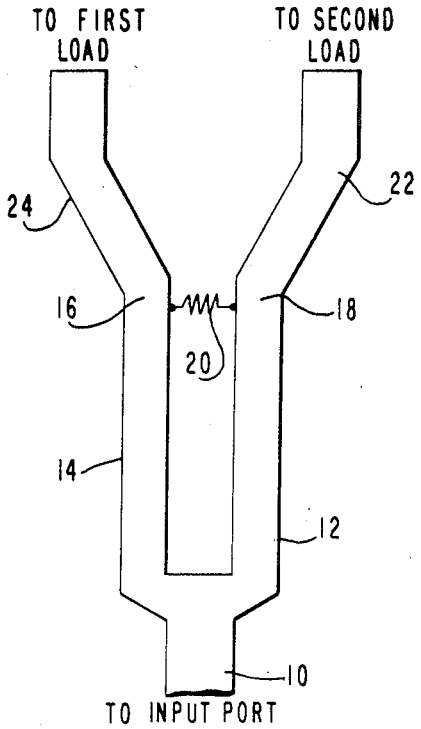
FIG. 1 PRIOR ART
FIG. 1 is a schematic diagram of a prior art split-tee coupler.

FIG. 1 is a schematic diagram of a prior art split-tee microwave coupler. The coupler includes a short section of microstrip circuit 10 which is coupled to the input port of the coupler. Two sections approximately $\frac{1}{4}$ wave length long of strip transmission line circuitry, 12 and 14, are coupled directly to the input section 10 with the second ends of these stripline circuits terminated at the first and second output ports 16 and 18. Coupled directly across the first and second output ports 16 and 18 is a termination resistor 20.

The split-tee coupler illustrated in FIG. 1 provides substantially identical power division between the first and second output ports, 16 and 18. Other power divisions can be provided by altering the relative dimensions of the two stripline circuits 12 and 14 with the circuit having the smaller dimensions receiving the smaller proportion of the power. Power dividers of this type are well known.

The output ports 16 and 18 can be coupled to the load using conventional techniques. Frequently, couplers are constructed to include other matching circuits which become necessary, particularly when unequal power distribution is involved. In the embodiment illustrated in FIG. 1, two additional sections of strip transmission circuitry 22 and 24 are provided to couple the output ports 16 and 18 to the loads without any additional matching sections. This arrangement is practical for substantially equal power division.

As is well known in the prior art, any power reflected from loads coupled to the first and second output ports 16 and 18 will be reflected to these ports. At the output ports 16 and 18, the power reflected from the first and second loads will include inphase and out-of-phase components. With respect to the out-of-phase component, a high-impedance circuit is provided between the first output port 16 and the input port by the quarter wavelength section 14. Similarly, a high-impedance circuit is provided between the second output port 18 and the input port by the second quarter wavelength section 12. The voltage representing this out-of-phase power will appear across the terminating resistor 20 and will be dissipated thereby without any portion being reflected back to the input port. However, the inphase component of the reflected power will be reflected to the input port of the coupler. This operation and characteristics of the split-tee coupler are well known in the prior art and are included for purposes of functional description only.

Figure 2:
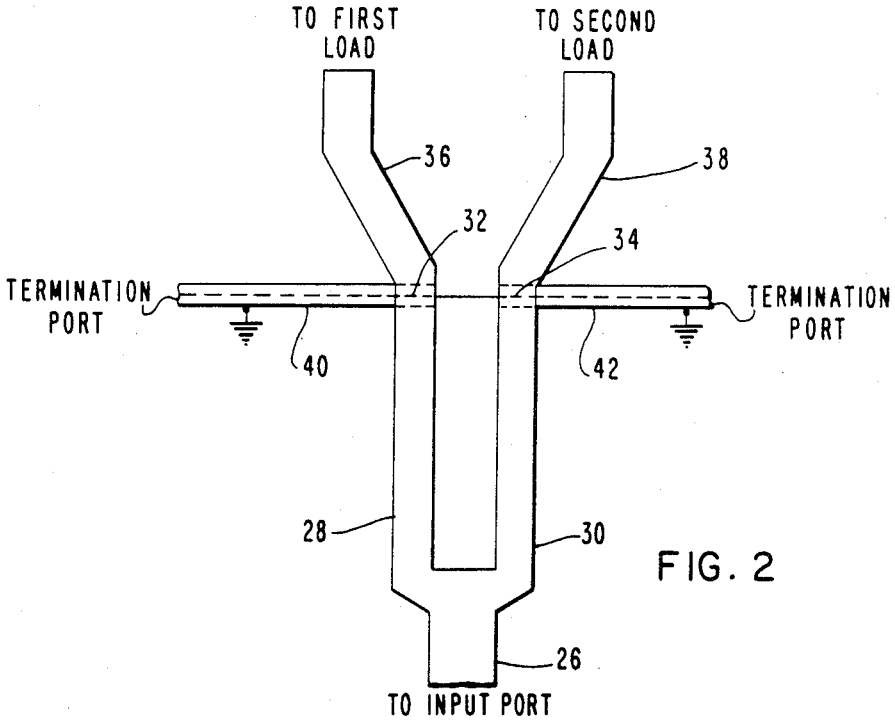
FIG. 2 is a schematic diagram of a first embodiment of the invention which provides two termination ports.

FIG. 2 is a schematic diagram of a first embodiment of the invention which provides balanced coupler formed by a multi-branch electrically conductive member. This embodiment includes provisions for use of two terminating resistors coupled to the output ports of the coupler. As in the prior art, a first section of a strip transmission line 26 couples the input port to first and second quarter wavelength microstrip circuits 28 and 30. The second end of the first microstrip 28 is coupled directly to the output port 32 and the second microstrip circuit 30 is coupled directly to the second output port 34. First and second strip transmission line sections 36 and 38 couple the output ports of the divider to first and second loads. Coupling of the output ports, 32 and 34, to termination resistors is provided by first and second sections of coaxial cable, 40 and 42. More specifically, the outer conductor of the first section coaxial cable 40 is connected directly to the first output port 32 and to the groundplane of the coupler at a location one-quarter wavelength from the first output port 32. Similarly, the outer conductor of the second coaxial cable 42 is connected the second output port 34 and to the groundplane of the circuit at a location disposed from the second output port 34 by one-quarter wavelength. The center conductors of coaxial cables, 40 and 42, are connected together. The second end of the first coaxial cable 40 is coupled to a first termination port. Similarly, the second output cable 42 is coupled to the second output port. Termination resistors equal to the characteristic impedance of the coupler are utilized at the first and second termination ports to provide a termination equal to twice the characteristic impedance of the transmission lines between the output ports, 32 and 34. This occurs because these two resistors are effectively in series in that any current flowing in either of the coaxial cables 40 or 42 flows through both resistors. Alternately, these ports can be used as isolated ports without resistors.

Figure 3:
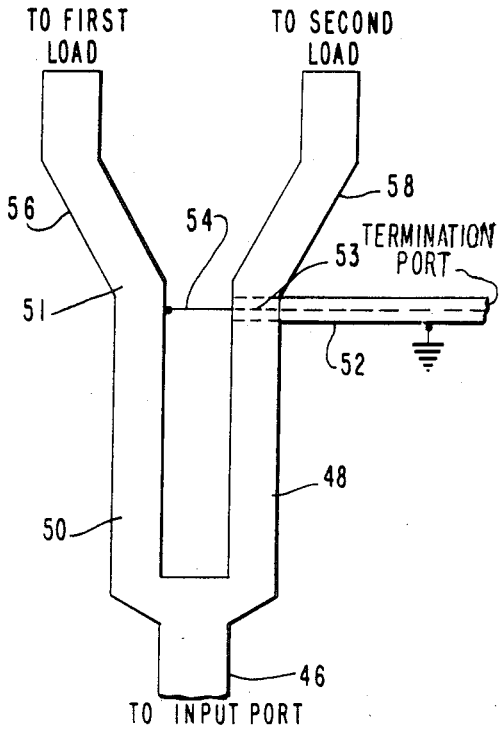
FIG. 3 is an embodiment of the invention which provides one termination port.

FIG. 3 is the schematic diagram of another embodiment of the invention using a multi-branch electrically conductive member and a single terminating resistor. A first section of strip transmission line 46 is coupled to the input port of the coupler. The second end of the strip transmission line 46 is coupled to the first ends of two additional $\frac{1}{4}$ wavelength sections of strip transmission lines 48 and 50. Second ends of the strip transmission lines 48 and 50, respectively, terminate at the first and second output ports 51 and 53. A quarter-wave section of coaxial transmission line has the outer conductor 52 thereof grounded at a location one-quarter wavelength from the second output port 53 and connected to the strip transmission line section 48 near second output port 53. Inner conductor 54 of the coaxial transmission line section 52 is connected to the second strip transmission line 50 near the first output port 51. Coaxial line 52 extends to the terminating port and is loaded with a resistor equal to twice the characteristic impedance of the strip transmission lines. Alternatively, if no terminating resistor is used, the port labeled termination port may be used as an isolated port. First and second transmission lines 56 and 58 coupled the first and second output ports to their respective loads.

Figure 4:
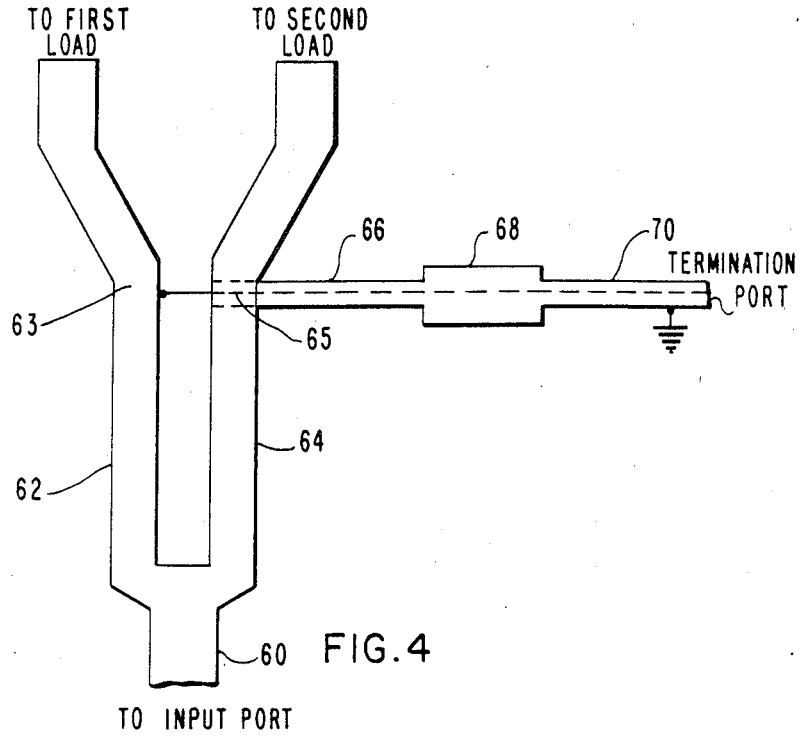
FIG. 4 is a diagram of a coupler including a choke to increase the bandwidth.

FIG. 4 is another embodiment of the invention illustrating the use of a choke section 68 to increase the bandwidth of the coupler. A first section of strip transmission line 60 is coupled to the input port of the coupler. First and second quarter-wave sections of transmission lines, 62 and 64, are coupled to the input port through the input section of strip transmission line 60. Strip transmission lines, 62 and 64, terminate in the first and second output ports, 63 and 65, of the coupler. A quarter wavelength of coaxial transmission line 66 has its outer conductor connected to the section of strip transmission line 64 at the second output port 65. The inner conductor of the coaxial transmission line 66 is connected to the first output port 63. A conventional choke 68 couples the first section of transmission line 66 to a second section of similar coaxial line 70. Transmission line 70 is coupled to the termination port and the outer conductor grounded. A terminating resistor equal to twice the characteristic impedance of the coupler is used to terminate the coupler.

Figure 5:
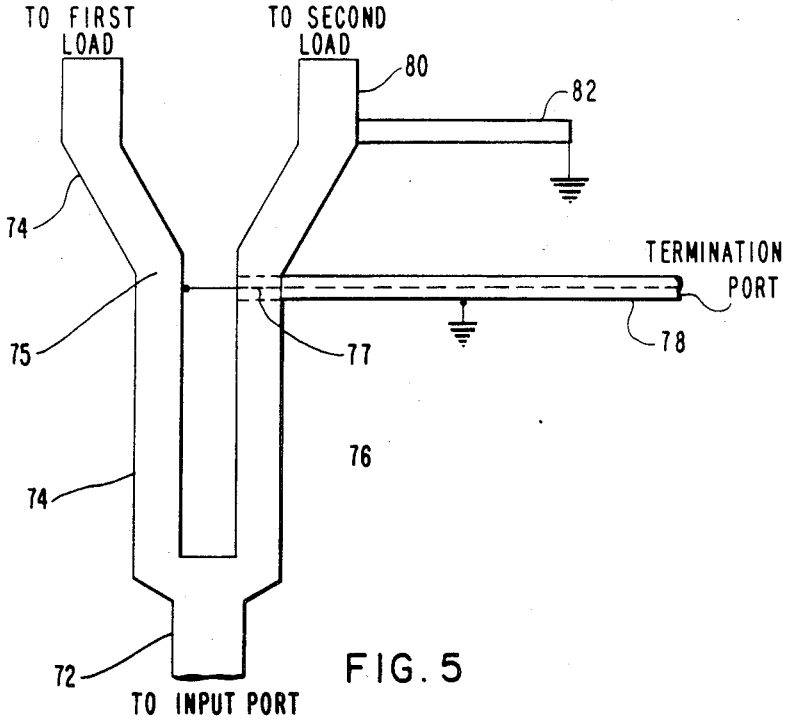
FIG. 5 is a diagram of a coupler using matching stubs to increase the bandwidth.

An alternate embodiment of the broadband coupler is illustrated in FIG. 5. A section of strip transmission line 72 is used to couple the input port to the first and second output ports, 75 and 77, through quarter wavelength sections of transmission lines, 74 and 76. A section of coaxial line 78 has the outer conductor connected to the second output port 77 and to ground at a quarter wavelength therefrom. The second end of the coaxial line 78 is coupled to the termination port. The inner conductor of the coaxial line 78 is connected to the first output port 77. The first and second output ports are coupled to their loads through conventional sections of transmission lines 78 and 80. An auxiliary section of transmission line 82 positioned a distance of approximately one-quarter wavelength from the second output port 77 is connected between the second transmission line and ground. This increases the bandwidth of the coupler, as is well known in the art.

Figure 6:
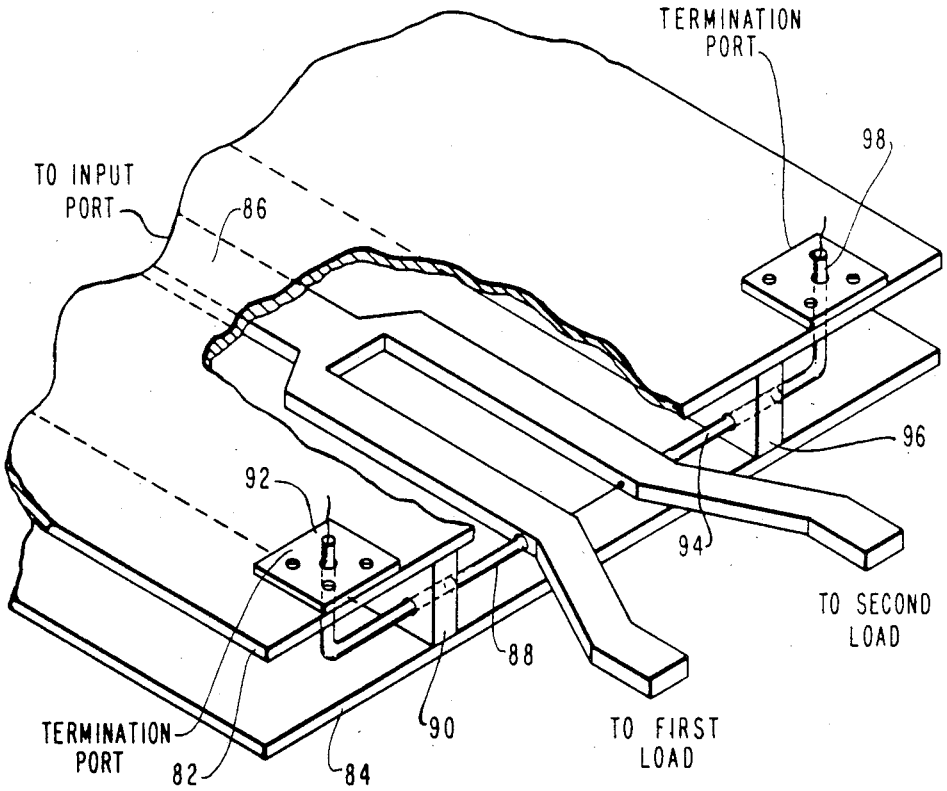
FIG. 6 is a drawing illustrating the structural features of the coupler illustrated schematically in FIG. 3.

FIG. 6 is an isometric diagram illustrating in more detail the implementation of the coupler illustrated in FIG. 3. More specifically, the coupler includes top and bottom electrically conductive plates, 82 and 84. An electrically conductive member 86, which, in conjunction with the electrically conductive top and bottom members, 82 and 84, form the strip transmission lines comprising a coupler. Electrically conductive member 86 is positioned between the top and bottom electrically conductive members, 82 and 84, by suitable insulators (not illustrated). A first section of coaxial transmission line 88 has its outer conductor connected to the electrically conductive member 86 at the first output port. A vertical support member 90 is electrically connected to the top and bottom plates, 82 and 84, at a distance approximately one quarter wavelength away from the first output port. The coaxial cable 88 extends through and has the outer connector thereof connected to the vertical support member 90. After passing through the vertical support 90 the coaxial cable 88 makes a turn of approximately 90° and extends up through the top electrically conductive member 82 to a coaxial connector 92. Coaxial connector 92 is the first termination port and may be connected to the terminating resistor using any convenient means.

A second coaxial cable 94 has its outer conductor connected to the electrically conductive member 86 at the second output port and to vertical electrically conductive member 96. Vertical member 96 is approximately one quarter wavelength from the second output port. After passing through the vertical support member 96, the coaxial cable 94 makes a bend of approximately 90° and extends through the upper member 82 and terminates in a coaxial connector 98. Coaxial connector 98 is the second termination port.

The center conductor of coaxial cable 88 extends through and is electrically isolated from the conductive member 86 near the second output port. Similarly, the center conductor of coaxial cable 94 extends through the electrically conductor member 86 at the first output port. In the space between the first and second output ports, the center conductor of coaxial cables 88 and 94 is connected together. Transmission lines of any convenient type may be utilized to couple the first and second output ports to their respective loads. The dimension of the various branches of electrically conductive member 86 are selected to give the desired characteristics to the divider.

Figure 7:
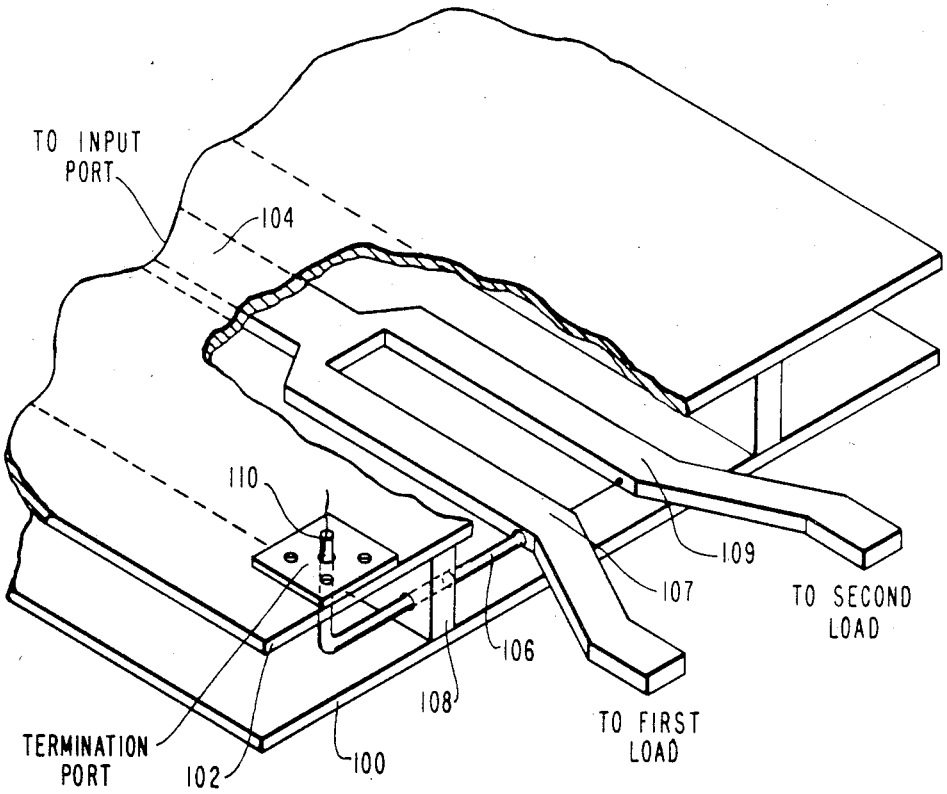
FIG. 7 is a drawing illustrating the structural features of the coupler illustrated in FIG. 2.

FIG. 7 is a more detailed embodiment of the coupler illustrated schematically in FIG. 3. More specifically, the coupler includes top and bottom electrically conductive plates, 100 and 102. An electrically conductive Y-shaped member 104 is supported between the top and bottom electrically conductive plates, 100 and 102, by insulators (not illustrated) to form the divider. A coaxial cable 106 extends from the first output port to a vertical electrically conductive member 108. The outer conductor of the coaxial cable 106 electrically connected to the vertical member 108 and to electrically conductive member 104 at the first output port 107. An opening is provided in the electrically conductive member 104 near the first output port with the inner conductor of the coaxial cable 106 extending through this opening and being electrically connected to member 104 at the second output port 109. Vertical member 108 is also electrically connected to the top and bottom plates 102 and is spaced from the first output port one-quarter wavelength at the operating frequency. Coaxial cable 106 extends through the vertical electrically conductive member 108 and makes a turn of approximately 90° and extends through the top member 102 and terminates in a coaxial connector 110. Coaxial connector 110 is the termination port of the divider. Loads can be connected to the first and second output ports using any convenient means.

The two embodiments illustrated in FIGS. 6 and 7 can be modified to broaden the bandwidth using the techniques schematically illustrated in FIGS. 4 and 5. More specifically, the coaxial cables of either embodiments can be modified to include a choke as illustrated in FIG. 4. Similarly, in FIG. 5 the transmission line section 82 is not specifically a part of the power divider but can be considered to be a portion of the transmission line assembly coupling the output ports to the load. In any case, the basic techniques for broadening the bandwidth of power dividers illustrated in FIGS. 4 and 5 are well known and can be easily applied to all embodiments of the coupler. The various embodiments of the invention have also been illustrated in substantially equal power division configurations. Other power divisions can also be achieved using prior art techniques. It should also be understood that the termination ports of the various embodiments of the invention can also be used as isolated ports. It should also be pointed out that the coupler is bi-directional permitting the functions of the ports labeled "output" and "input" to be interchanged.

I claim:

1. A microwave coupler comprising:
(a) a first port coupled to first ends of first and second microstrip transmission lines (28 and 30), said first and second transmission lines (28 and 30) having a predetermined electrical length;
(b) second and third ports (32 and 34) respectively coupled to third and fourth microstrip transmission lines (36 and 38) and to second ends of said first and second microstrip transmission lines (28 and 30); and
(c) coaxial transmission line means (40 and 42) coupled to said second ends of said first and second microstrip transmission lines (28 and 30), said coaxial transmission line means extending to at least one remote location and terminating thereat.

2. A microwave coupler in accordance with claim 1 wherein at least one outer conductor of said coaxial transmission line means (40 and 42) is connected to at least one of said second ends of said first and second microstrip transmission lines (28 and 30).

3. A microwave coupler in accordance with claim 1 wherein said coaxial transmission line means has at least one outer conductor connected to at least one ground reference terminal at a predetermined distance from said second ends of said first and second microstrip transmission lines (28 and 30).

4. A microwave coupler in accordance with claim 3 wherein said coaxial transmission line means is connected to said ground reference at a location substantially one-quarter wavelength from said second port.

5. A microwave coupler comprising:
(a) first and second substantially flat electrically conductive plates (100 and 102);
(b) a microstrip circuit including a multi-branch electrically conductive member (104) having at least first, second and third branch members, said at least first, second and third branch members, each having first and second ends, and being sandwiched between and electrically insulated from said first and second electrically conductive plates (100 and 102) with said first ends of said first, second, and third electrically conductive members respectively forming an input port and output ports (107 and 109) of said coupler with said second ends joining at a common point to form said multi-branch electrically conductive member 104;
(c) coaxial transmission line means (106) coupled to said first ends of said at least second and third branch members, said coaxial transmission line means (106) extending to at least one remote location and terminating thereat.

6. A microwave coupler in accordance with claim 5 wherein said coaxial transmission line means includes first and second sections of coaxial transmission lines, said first and second sections of coaxial transmission having a common inner conductor, the outer conductors of said first and second sections of coaxial transmission line being respectively connected to said first ends of said second and third members, said first and second sections of coaxial transmission line providing electrical conductive connections to first and second coaxial connectors positioned at first and second remote locations.

7. A microwave coupler comprising:
(a) a first port coupled to first ends of first and second microstrip transmission lines (48 and 50), said first and second microstrip transmission lines (48 and 50) having a predetermined electrical length;
(b) second and third ports (51 and 53) respectively coupled to third and fourth microstrip transmission lines (56 and 58) and to second ends of said first and second microstrip transmission lines (48 and 50); and
(c) coaxial transmission line means coupled to said second ends of said first and second microstrip transmission lines (48 and 50), said coaxial transmission line means extending to at least one remote location and terminating thereat.

8. A microwave coupler in accordance with claim 7 wherein the outer conductor 52 and inner conductor (54) of said coaxial transmission line means are respectively connected to said second ends of said first and second microstrip transmission lines (48 and 50).

9. A microwave coupler in accordance with claim 8 wherein said coaxial transmission line means has the outer conductor (52) thereof connected to a ground reference terminal at a predetermined distance from said second ends of said first and second microstrip transmission lines (48 and 50).

* * * * *